United States Patent [19]

Rudolph et al.

[11] 4,428,283

[45] Jan. 31, 1984

[54] METHOD AND APPARATUS FOR SILK SCREEN PRINTING ON CONICAL OR CYLINDRICAL CONTAINERS

[76] Inventors: Rome R. Rudolph, 4113 Lee Rd., Gibsonia, Pa. 15044; Carl Strutz; Frank C. Strutz, both R.D. 2, Camp Trees Rd., Mars, Pa. 16046

[21] Appl. No.: 270,869

[22] Filed: Jun. 5, 1981

[51] Int. Cl.[3] ..... B41F 17/22; B41F 17/28; B41F 17/00

[52] U.S. Cl. ..... 101/35; 101/126; 101/129

[58] Field of Search ..... 101/35, 126, 129, 123, 101/124, 426

[56] References Cited

U.S. PATENT DOCUMENTS

| | | | |
|---|---|---|---|
| 2,111,207 | 3/1938 | Denelsbeck | 101/126 X |
| 2,113,605 | 4/1938 | Schutz | 101/38 R X |
| 2,166,269 | 7/1939 | Smith | 101/123 |
| 2,605,700 | 8/1952 | Martin | 101/123 |
| 2,895,412 | 7/1959 | Reed | 101/126 X |
| 2,918,866 | 12/1959 | Reed | 101/126 X |
| 3,054,345 | 9/1962 | Martin | 101/123 |
| 3,209,688 | 10/1965 | Eldred et al. | 101/126 X |
| 3,309,985 | 3/1967 | Nowak | 101/126 X |
| 3,316,837 | 5/1967 | Scheck | 101/126 X |

*Primary Examiner*—Clifford D. Crowder

*Attorney, Agent, or Firm*—Thomas H. Murray; Clifford A. Poff

[57] ABSTRACT

Printing on a cylindrical or conical surface of a container is carried out by a method and apparatus wherein the container is supported against rotation about a support axis. A squeegee is positioned at one side of a decorating screen to establish line contact between the opposite side of the screen and the surface of a container. The decorating screen is rolled along a tangential path about the surface of the container and concurrently the squeegee is moved along an orbital path about the support axis to force printing medium through the screen onto the surface of the container at the line of contact therewith.

22 Claims, 11 Drawing Figures

31
32
36
43
35
46
38
50
48
45
47
39
44
37
33
34
49
42
40
26
10
18
19
15
16
21
22
23
24
25
27
17
12
11
54
53
52
55
14

95C
95B
95A
95
10
55

50
51
56
39
57
58
77
78
82
IV
61
62
62
64
59
76
79
52
76
81
60
65
71
75
54
53
V
74
11
72
73
55

Fig. 7
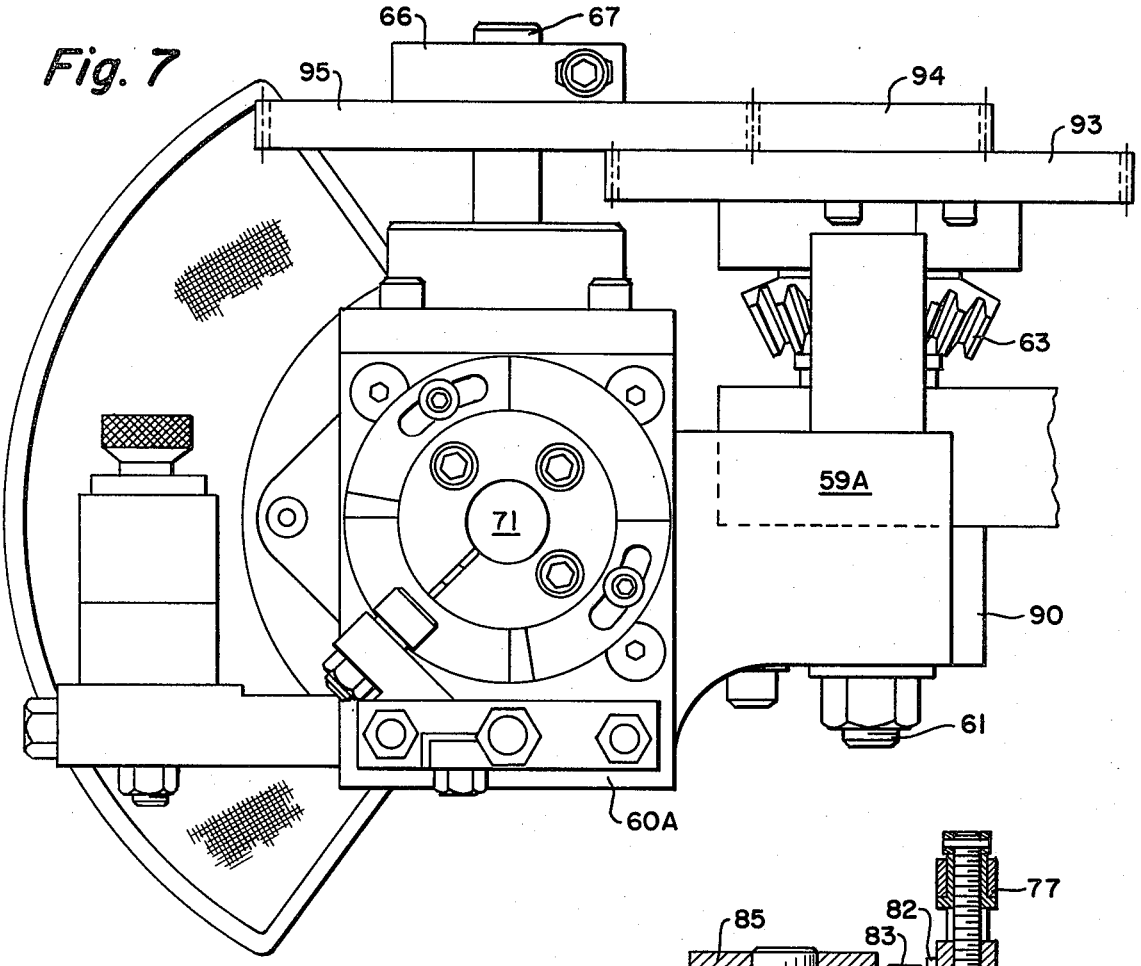
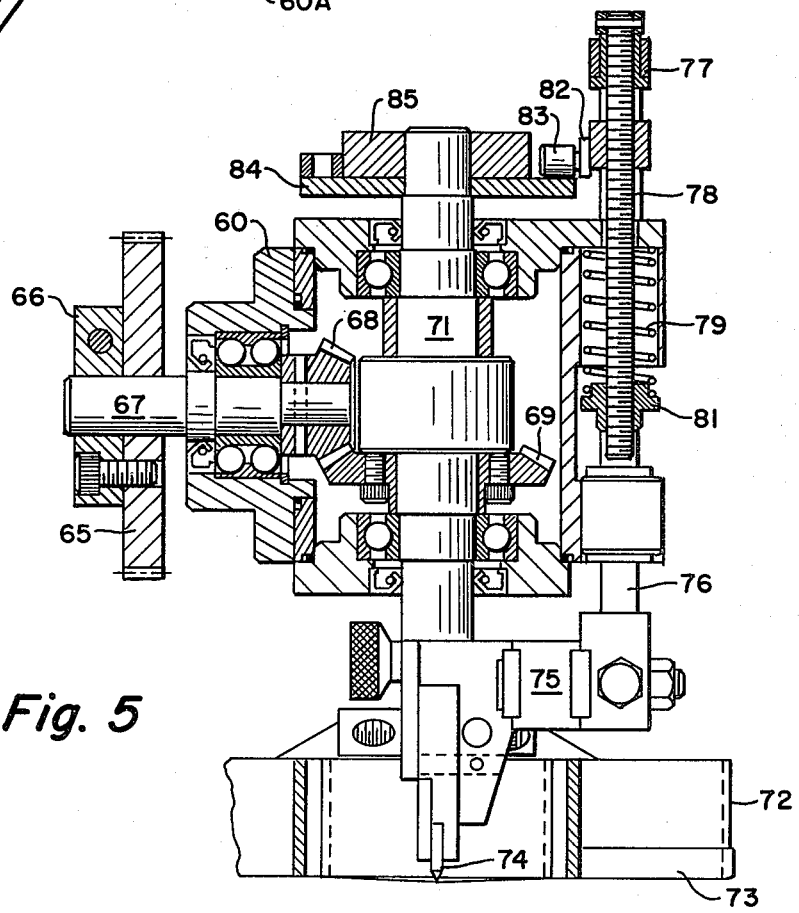
Fig. 5

METHOD AND APPARATUS FOR SILK SCREEN PRINTING ON CONICAL OR CYLINDRICAL CONTAINERS

BACKGROUND OF THE INVENTION

This invention relates to a method and apparatus for decorating a surface of a workpiece, and more particularly, to a method and apparatus wherein a workpiece is held against rotation about a support axis while a decorating screen rolls along a tangential path about the surface of the workpiece and concurrently a squeegee is moved along an orbital path about the support axis to force ink through the screen onto a conical or cylindrical surface of the workpiece at a line of contact therewith.

An intermittent motion-type decorating machine is known in the decorating field of art wherein a drive is provided to impart an intermittent traveling motion to a workpiece such as bottles made of glass, plastic or the like as well as other forms of containers. The bottles are moved through a predetermined distance, stopped, moved again through a predetermined distance, stopped and so forth until each bottle has moved completely through the decorating machine. A decorating station may be provided at each of the places where the bottles come to a complete stop. At a decorating station, a decorating screen is displaced into line contact with the surface of the bottle by an associated squeegee. The bottle is rotated and the squeegee remains stationary in alignment with the axis of rotation of the bottle. The screen is passed or moved across the bottle while in rolling contact therewith. Examples of such intermittent motion-type decorating machines will be found, for example, in U.S. Pat. Nos. 2,231,535, 2,261,255, 2,721,516 and 3,146,704.

Other decorating apparatus take the form of a continuous motion-type decorating machine wherein the workpieces, such as bottles, are conveyed through the machine at a constant linear speed. At each of a succession of decorating stations along the path of travel, there is a decorating screen which remains stationary with respect to the station and a squeegee displaces the screen into line contact with the bottle. The squeegee is moved in the same direction and at the same velocity as the workpiece which is rotated about its longitudinal axis while in rolling contact with the stationary or moving decorating screen. Examples of a continuous motion-type decorating machine will be found, for example, in U.S. Pat. Nos. 2,027,102, 2,121,491, 2,132,818 and 3,251,298.

In either the continuous-type or intermittent-type decorating machines, a small amount of slippage usually occurs at the driven connection between the bottle and rotational drive shaft. Typically, the bottle is engaged by a neck chuck at one end and a base chuck at its opposite end. Misalignment between the rotational axis of a neck or base chuck with respect to the longitudinal axis of the bottle will bring about a slippage during each revolution of the bottle. Slippage also occurs due to surface and shape irregularities on the bottle at the sites engaged by the neck and base chucks. Such slippage will distort the printed pattern which is defined by the flow of ink or other printing medium through open spaces in the screen. Such distortion is undesirable, but it is far more detrimental to the appearance of the decorative imprint when comprised of two or more colors because any small amount of misregistration between a previously-applied decorative imprint and the decorative imprint next to be applied is noticeable.

SUMMARY OF THE INVENTION

It is an object of the present invention to provide a method and apparatus for decorating a surface of a workpiece in which a decorating screen and squeegee associated therewith move along the surface of the workpiece while it is held against rotation, thereby eliminating undesirable slippage by the need to transmit toque to the workpiece.

It is a further object of the present invention to provide a method and apparatus for decorating a workpiece held against rotation during one or more sequential decorating operations wherein a squeegee is orbited about the surface of the workpiece and a decorating screen is moved tangentially about the surface of the workpiece to form line contact between the screen and the workpiece.

More particularly, according to the present invention there is provided a method of decorating a conical or cylindrical surface of a workpiece by the steps comprising supporting the workpiece against rotation about an axis spaced from the surface of the workpiece for decorating, positioning a squeegee at one side of a decorating screen to establish line contact between the opposite side of the screen and the surface of the workpiece, rolling the decorating screen along a tangential path about the surface of the workpiece and concurrently therewith moving the squeegee along an orbital path about the support axis to force a printing medium through the screen onto the surface of the workpiece at the line of contact therewith.

Usually, the tangential path of the decorating screen is spaced from the surface of the workpiece and the squeegee is used to form line contact between the surface of the workpiece and the decorating screen. For decorating a cylindrical surface of a workpiece, the face of the screen forms a right angle with the support axis and moves about an axis corresponding to the support axis of the workpiece. The pivot axis of the screen forms an angle with the support axis when decorating a conical surface of the workpiece. In the preferred form, the workpiece is moved along a path of travel while supported against rotation when decorating the surface thereof.

In the apparatus of the present invention, means such as a chuck member and a conveyor flight attachment engage opposite ends of the workpiece to support it against rotation about a support axis, a decorating screen including openings defining a desired pattern for printing on the surface of the workpiece, squeegee means to force a printing medium through openings in the screen, screen drive means to move the screen for rolling contact along a tangential path about the surface of the workpiece, squeegee drive means to move the squeegee means in an orbital path about the support axis of the workpiece to force a printing medium through the openings in the screen while in line contact with the workpiece, and housing means to move about the support axis of the workpiece for carrying the screen and squeegee drive means.

Means, such as a conveyor, is preferably arranged to advance the workpieces along a path of travel during a decorating process. Housing means is provided for supporting the squeegee and screen. This housing means, in the preferred form, is rotated about the support axis of the workpiece. A carrier extending from the housing means supports the squeegee and reciprocates into and away from the screen as the housing means is rotated. The screen is supported and driven by a pivot shaft housed for rotation in the housing means. The screen drive means includes the pivot shaft, a pinion gear coupled to the pivot shaft and a drive gear supported by the housing means for rotation with the housing means about the support axis of the workpiece. The screen drive means further includes a train of gears meshing in driving relationship with the pinion gear and drive gear, and a bevel gear coupled to the drive gear and engaged for meshing rotation with a second bevel gear supported in a fixed, non-rotatable position about the support axis of the workpiece.

These features and advantages of the present invention as well as others will be more fully understood when the following description of the various embodiments thereof is read in light of the accompanying drawings, in which:

FIG. 5 is a sectional view taken along line V—V of FIG. 3;

FIG. 7 is a sectional view taken along line VII—VII of FIG. 6;

Figure 1:
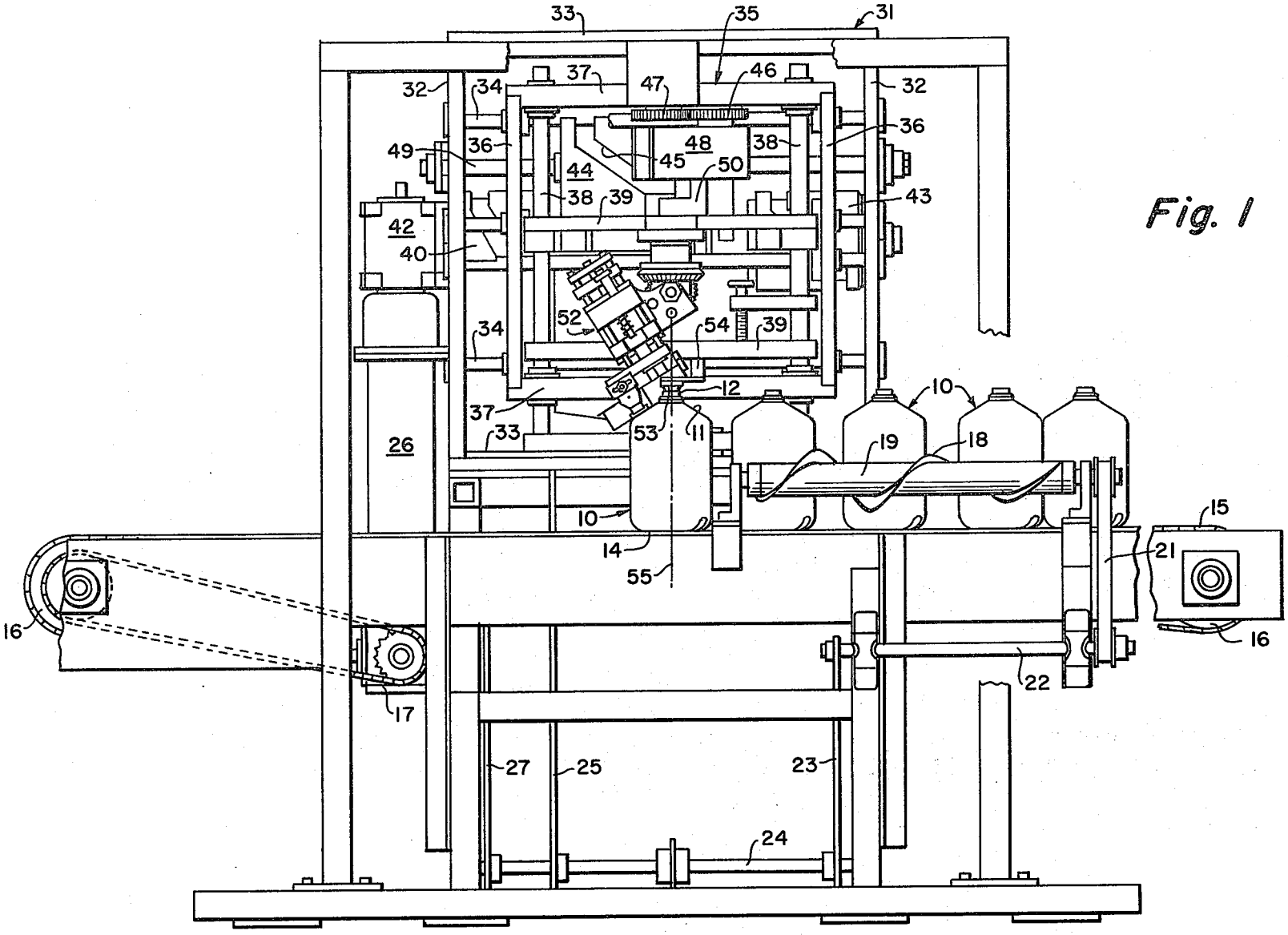
FIG. 1 is an overall elevational view of a decorating machine embodying the features of the present invention.
Figure 2:
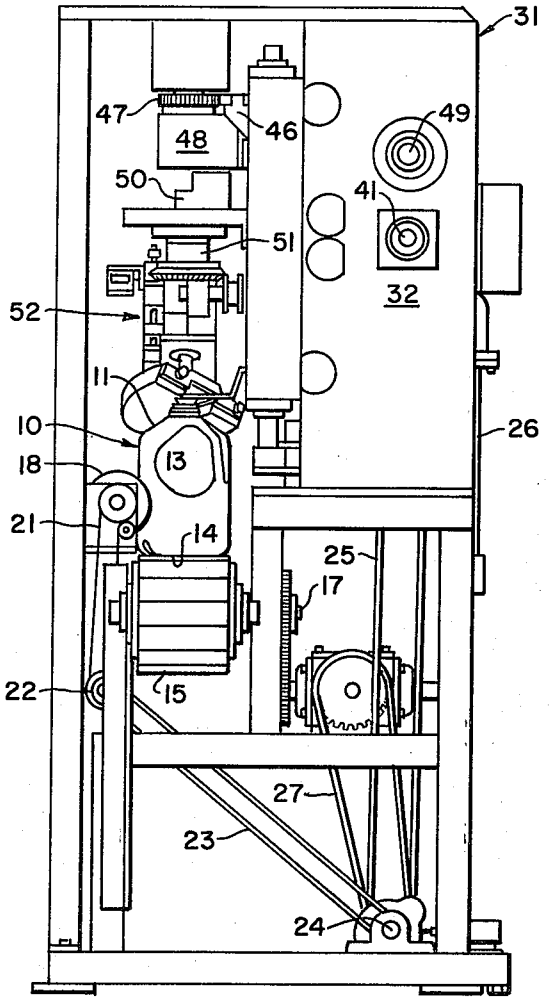
FIG. 2 is a side elevational view of the decorating machine shown in FIG. 1.

In FIGS. 1 and 2, there is illustrated the general layout of one form of apparatus according to the present invention which is also useful to carry out the method for decorating a workpiece. The workpiece shown in the drawings is a plastic container for milk or similar products. The container, a number of which is shown in FIG. 1 and identified by the reference numeral 10, has a generally square shape with rounded corners and an upper conical side wall surface 11. Surface 11 forms a transition wall with an annular neck portion 12 which has threads to receive a closure cap. As shown in FIG. 2, two side walls of the container form a hollowed-out area that defines a handle 13. A bottom wall 14 of the container is supported on flight attachments 15 secured at uniformly-spaced intervals to endless chains extending between sprockets 16, one of which is coupled to a gear drive 17. The plastic containers are separated from one another by a predetermined distance essentially defined by the pitch of a spirally-shaped feed attachment 18 on a shaft 19. The shaft 19 extends horizontally along one side of the conveyor at a location spaced above the flight attachments. Shaft 19 is supported by journals at its opposite ends, one of which is extended and engaged with a pulley that is coupled by a belt 21 to a pulley on an idler shaft 22. Shaft 22 is driven by a chain 23 extending to a drive shaft 24 that is, in turn, connected by a chain 25 to a gear drive 26 including a motor. Chain 27 couples the drive shaft 24 to gear drive 17 for transmitting torque from drive 26 to the sprocket 16 of the conveyor. Only one drive 26 is used so that movement of the plastic containers by the conveyor is synchronous with operation of the decorating apparatus.

Figures 3, 8:
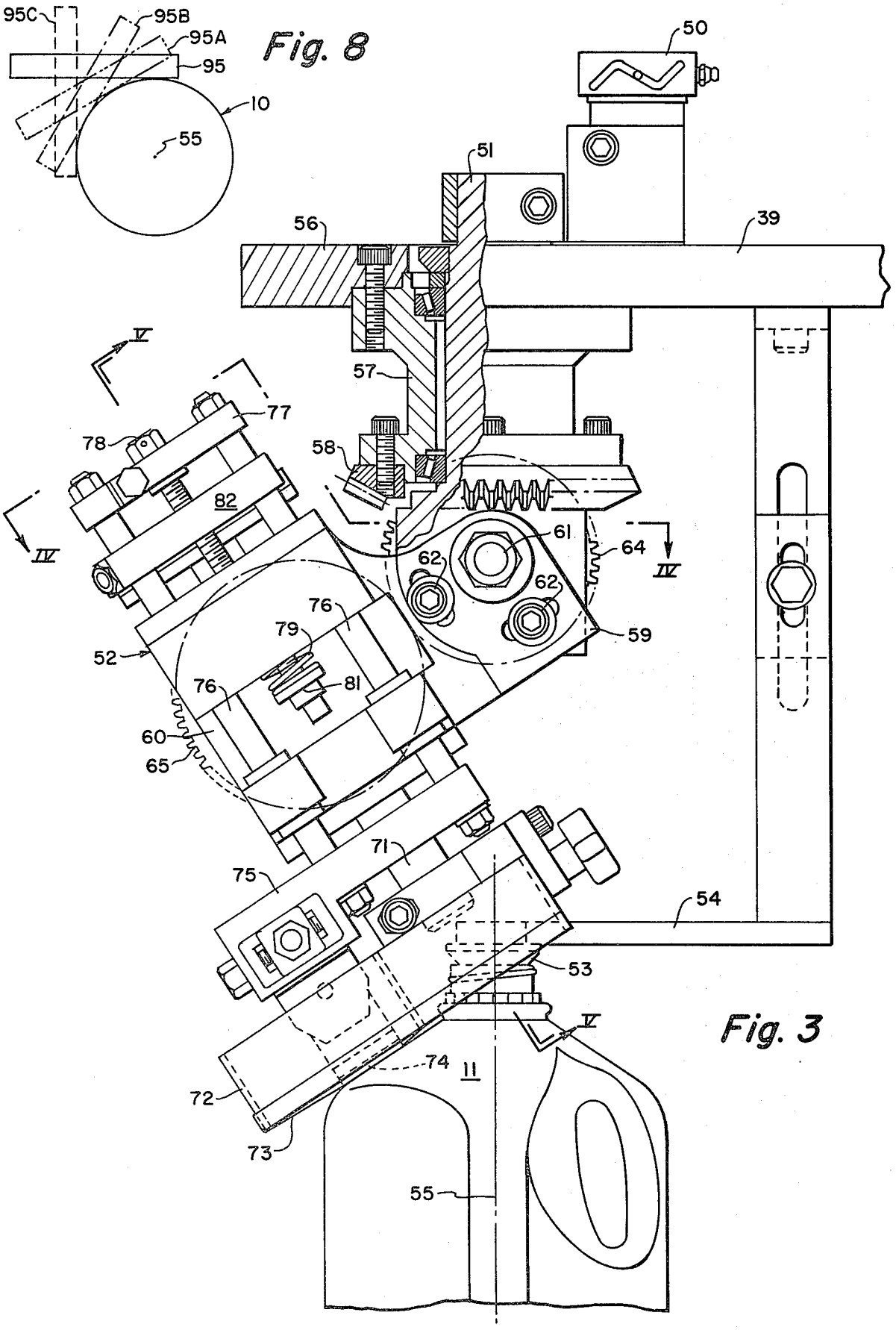
FIG. 3 is an enlarged fragmentary elevational view of the decorating apparatus shown in FIG. 1.
FIG. 8 is a schematic illustration of a further embodiment of the present invention for decorating a cylindrical surface of the workpiece.

In FIGS. 1 and 2, conveyor 15 extends along one side of a rectangular main carrier frame 31 including spaced-apart vertical side plates 32 joined together at their opposite ends by spacer plates 33. The frame 31 supports spaced-apart horizontal slide bars 34 which carry a horizontal slide frame 35. Frame 35 includes spaced-apart vertical side plates 36 joined together at their opposite ends by crossheads 37. The crossheads support vertical guide bars 38 engaged with a vertical slide frame 39. Frame 39 is reciprocated along bars 38 by a bellcrank, not shown, connected at one end to the frame 39 and rocked back and forth about a central pivot by the engagement of a cam follower on its free end with a lifting cam 40. The cam 40 is supported by a shaft 41 carried on the main frame 31 and driven by a gear reducer 42. The horizontal slide frame 35 is reciprocated back and forth on bars 34 by a cam follower extending from the frame into a cam track of a cam 43 which is secured to shaft 41 for rotation thereby and driven by gear reducer 42. A 360° rack drive cam 44 has a cam track 45 engaged with a follower extending from a gear rack carriage 46 supported for horizontal reciprocation and engagement with a gear 47 which is attached for rotating the vertical axis of a coupling member 48. A shaft 49 supports the cam 44 on main frame 31 while driven by a geared connection to drive shaft 41. Coupling member 48 has spaced-apart side plates forming a cavity that receives a crank arm 50 on a vertically-extending drive shaft 51 (FIG. 3). Crank arm 50 slides vertically in the pocket in coupling member 48 while maintaining a driving relation therewith. By this contruction, a driving relation is maintained between the vertical slide frame 39 and drive shaft 51 while moving vertically relative to coupling member 48 and the horizontal slide frame which supports them.

As will be understood by those skilled in the art, the cams 40, 43 and 44 are rotated by the same drive 26 which rotates the sprocket 16 whereby the motion imparted to the horizontal and vertical slide frames displaces a decorating head assembly 52 in a timed relation with the movement of the plastic containers by the conveyor. The movement of horizontal slide frame 35 in a horizontal direction relative to main frame 31 throughout the actual decorating process is synchronous with movement of the containers. Prior to the decorating process, the vertical slide frame 39 is moved downwardly to a position where the decorating head assembly is in proper position for the printing process and simultaneously a chuck member 53 carried by the bracket 54 on the vertical slide frame engages with the plastic container under a sufficient force to hold it against rotation about a vertical support axis of the container. Such an axis is identified in FIGS. 1 and 3 by reference numeral 55.

Figure 4:
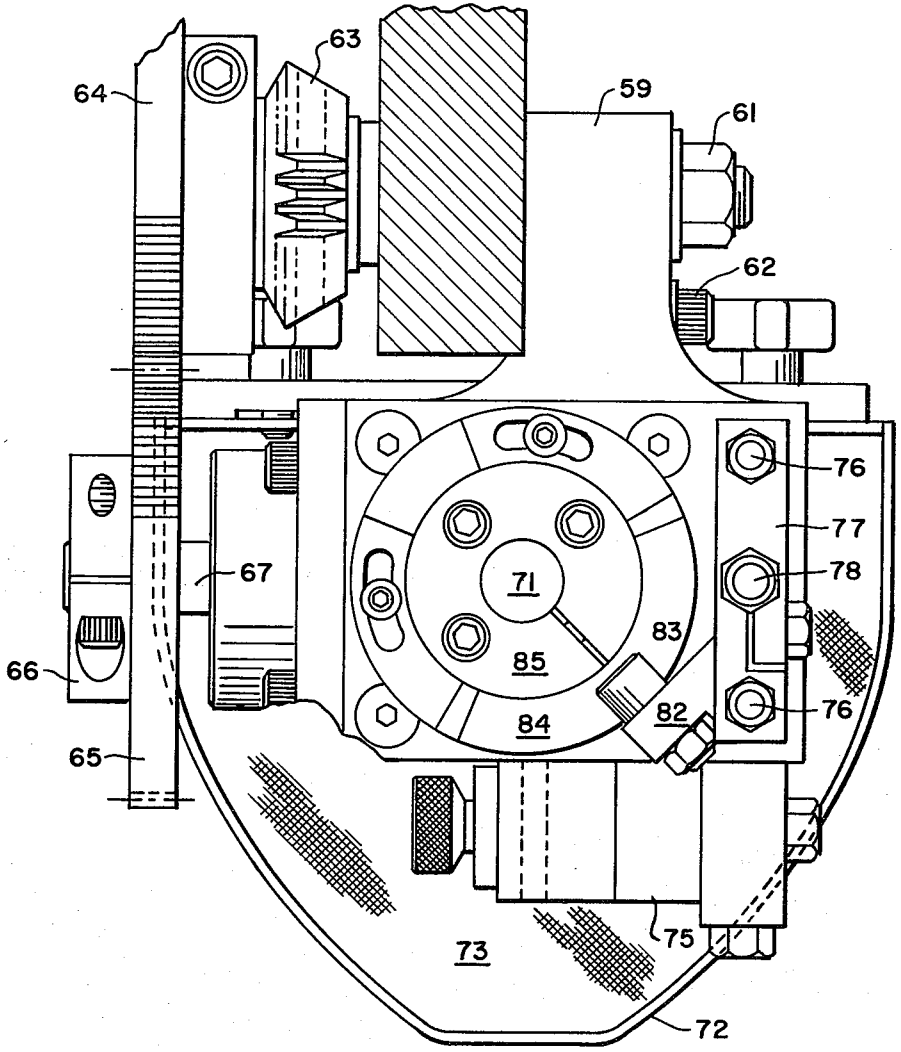
FIG. 4 is a sectional view taken along line IV—IV of FIG. 3.

FIGS. 3–5 illustrate the construction of the decorating head 52. Vertical slide frame 39 includes an outwardly-projecting support plate 56 that overlies containers when transported along the path of travel by the conveyor. The support plate has a bore through which drive shaft 51 extends. A support sleeve 57 is attached by threaded fasteners to support plate 56 and carries bearings that rotatably support shaft 51. A bevel gear 58 is secured by threaded fasteners to the lower end of sleeve 57. The lower end of drive shaft 51 has a machined flat face onto which there is attached a projecting wing 59 of a housing 60 by a nut and bolt assembly 61. Slotted openings in the housing wing receive other threaded fasteners 62 which secure the housing to the drive shaft when a desired angular relation is established. The head portion of nut and bolt assembly 61 has an extended length and it is machined to form an arbor for rotatably supporting a bevel gear 63 for rotation about a generally horizontal axis at right angles to the rotational axis of shaft 51 and in meshing engagement with bevel gear 58. A spur gear 64 is bolted to the flange of bevel gear 63 and meshes with a spur gear 65 that is attached by a flange 66 to a pivot shaft 67. As shown in FIG. 5, the pivot shaft 67 is supported by bearings in the housing 60 and carries a bevel gear 68 within a cavity of the housing. The bevel gear 68 meshes with a bevel gear 69 mounted on arbor 71 for rotation about an axis that forms an acute angle with support axis 55 when printing upon a conical surface of the container. Arbor 71 extends from the lower end of the housing where it supports a frame 72. Frame 72, part of the silk-screen assembly, is shaped in the form of a crescent. The frame 72 supports a screen 73 having openings defining a desired pattern which is to be printed on the container by forcing ink or other printing medium through the openings in the screen.

It can be seen from FIGS. 3 and 4 that rotation of shaft 51 rotates the silk screen about the axis of shaft 71 along the conical surface 11 of the container. The silk screen is positioned by the housing at a close, normally non-engaging relation with the surface 11. Line contact with surface 11 occurs by the pressure exerted on the screen from a squeegee 74 which engages the screen with line contact at its surface which is opposite the screen surface facing the container. The squeegee 74 is carried by a frame 75 that is, in turn, supported by guide rods 76 extending through openings in the housing to project from the opposite end thereof where a crosshead 77 joins the guide rods together. The rods transmit a biasing force to the squeegee from the relatively long threaded bolt 78 that extends through an opening in the housing. The lower end of the threaded bolt engages a spring 79 that is held captive on the bolt 78 against the housing by a fastener 81. To control movement of the squeegee for establishing line contact with the surface of the container, a bracket 82 extends from guide rods 76 and carries a follower roller 83 that rides along the surface of a rotary cam 84. An attachment plate assembly 85 secures the cam to a projecting end portion of shaft 71 which is opposite the squeegee and silk screen.

Rotation of the housing about the sleeve 57 brings about a rolling of the decorating screen along a tangential path about the conical surface of the container and concurrently therewith the squeege is moved along an orbital path about the support axis 55. The squeegee is moved to form line contact with the surface of the container when a depressed area of the cam 84 underlies the follower 83 whereby push rods 76 are urged by spring 79 toward the container.

Figure 6:
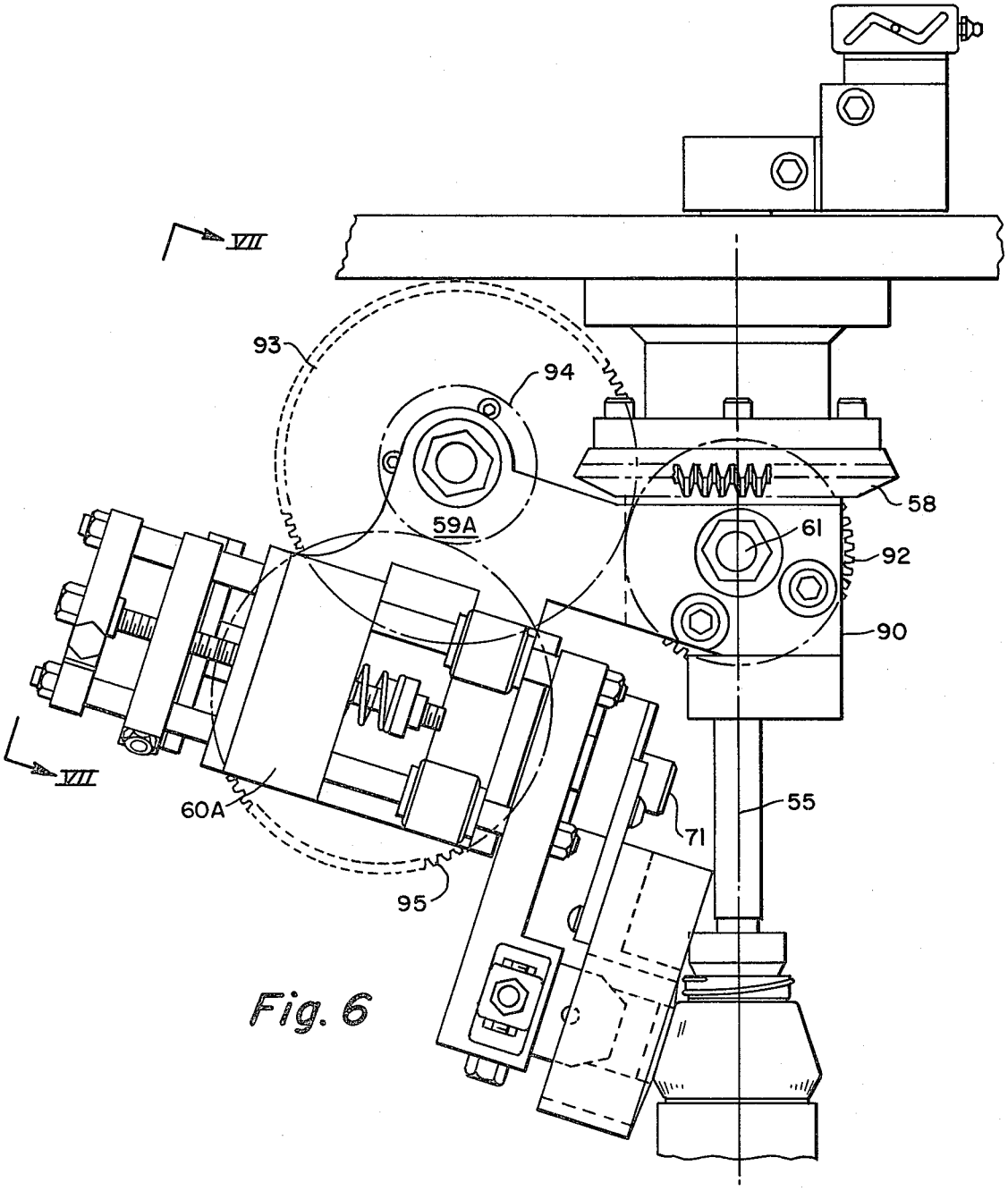
FIG. 6 is an enlarged fragmentary elevational view similar to FIG. 3 but illustrating a second embodiment of the printing apparatus according to the present invention.

FIGS. 6 and 7 illustrate a further embodiment of the present invention in which a larger angular relation exists between the rotational axis of the screen formed by shaft 71 for the rolling movement of the screen about a tangential path of the surface of a container. In this regard, housing 60A differs from housing 60 described hereinabove by the provision of a support flange extending from the housing wing. The flange which is identified in FIG. 6 by reference numeral 90 is used to support the housing by the use of the nut and bolt assembly 61 as previously described which also supports bevel gear 63 for meshing engagement with bevel gear 58. Bolted to bevel gear 63 is a spur gear 92 that meshes with an idler gear 93. An idler gear 94 is bolted to gear 93, both of which are supported for rotation on an arbor shaft carried by the projecting wing 59A of housing 60A. A drive gear 95 is mounted on shaft 67 by mounting collar 66. The use of idler gears 93 and 94 permits placing the housing at a greater angle, i.e., approaching 90°, between the support axis of the container and axis of rotation formed by shaft 71 for the rolling contact of the screen as described above. The rotational axis of shaft 71 is perpendicular to the conical surface of a workpiece. The operation of the squeegee is essentially the same as described previously and, therefore, the same reference numerals have been applied to corresponding parts in FIGS. 6 and 7. In view of the foregoing, it will now be apparent to those skilled in the art that a right-angle relationship between the support axis of a container and the pivot axis of the screen, while forming line contact with the surface of the article, can be readily accomplished by constructing the wing and arm portion of the housing so that the rotational axis of shaft 71 forms a right angle with the support axis 55. Proper driving relationship can be readily maintained with the idler gear 93 to bring about a rolling of the decorating screen about the surface of the article. As depicted schematically in FIG. 8, when the decorating screen 95 is rolled about a cylindrical surface of an article, it assumes positions 95A, 95B and finally 95C. At the same time, the squeegee moves in an orbital path about the support axis 55 forcing printing medium through the openings in the screen and establishing line contact between the screen and the surface of a container.

Figure 9:
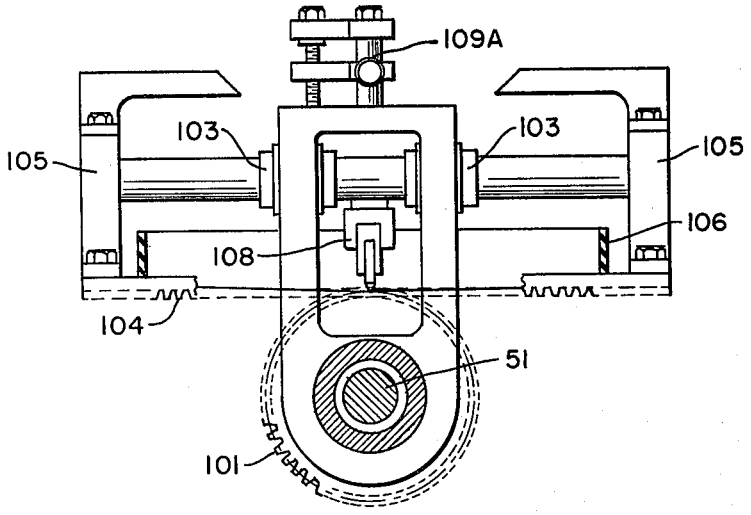
FIG. 9 is a plan view of apparatus to illustrate the embodiment of the present invention shown schematically in FIG. 8.
Figure 10:
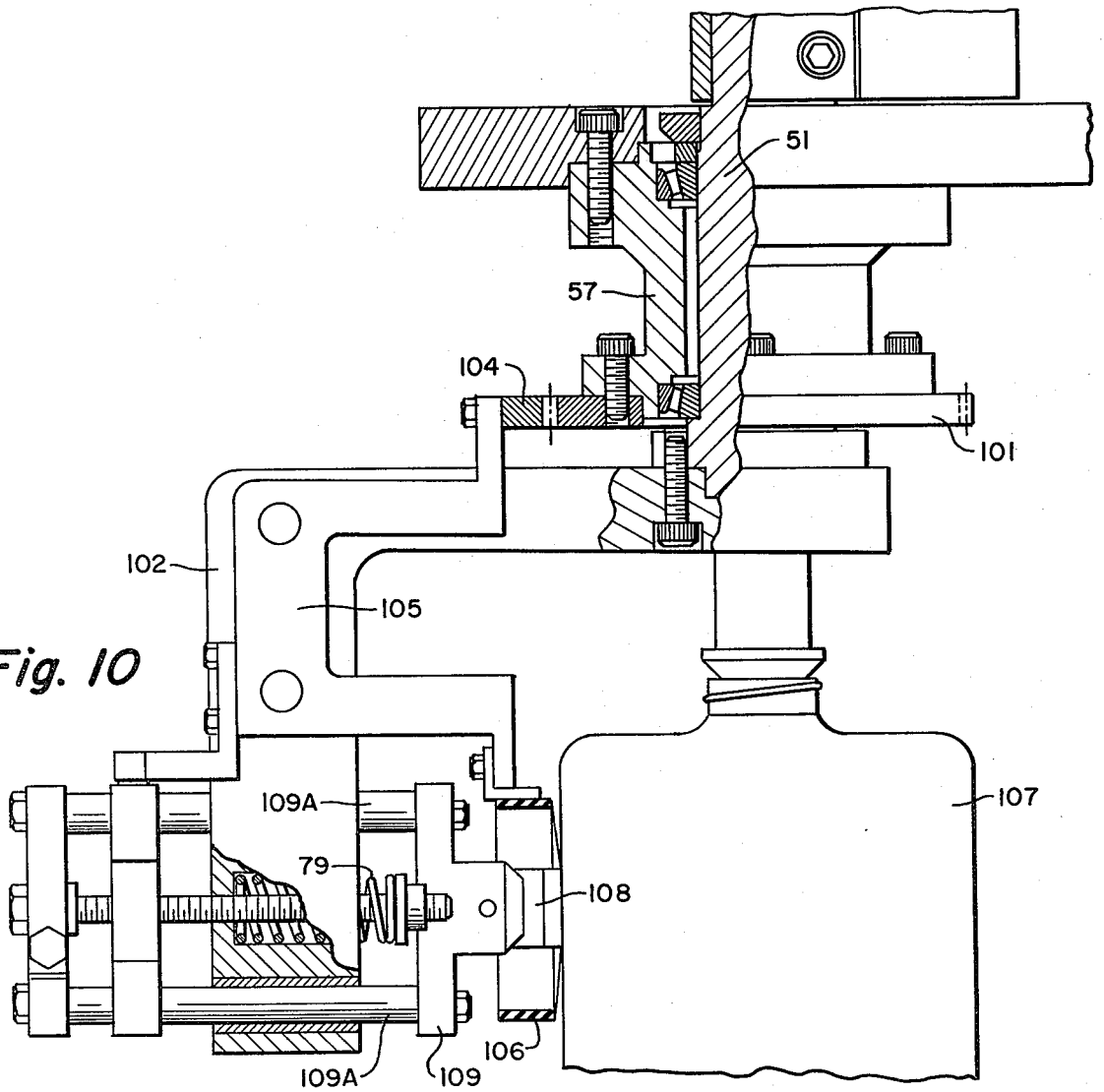
FIG. 10 is a sectional view taken along line X—X of FIG. 9.

FIGS. 9 and 10 illustrate a simplified form of apparatus for printing in this manner on the cylindrical surface of a workpiece. A pinion gear 101 is mounted coaxially with the support axis 55 for the workpiece to the support sleeve 57 instead of the bevel gear 58 as described previously in regard to FIGS. 3 and 6. The same reference numeral identifies the same parts in FIGS. 9 and 10 as already described in regard to FIGS. 1–7. Drive shaft 51 is secured to a housing 102 that has a generally U-shaped configuration in the plan view shown in FIG. 9. Projecting leg portions of the housing 102 each includes a linear bearing 103 to slideably support an end portion of a rack 104. The rack is supported for reciprocating movement in the direction of its length such that the rack teeth mesh with the teeth of pinion gear 101. Secured to the central part of the rack is a frame 105 that carries a silk screen 106. In this aspect of the invention, the pitch diameter of the gear teeth of pinion gear 101 substantially corresponds to the diameter of the cylindrical surface of the workpiece 107 upon which printing is to be carried out. The frame 105 is attached to the rack so that the screen is closely spaced, e.g., by a slight airgap, from the cylindrical surface of the workpiece. A squeegee 108 is arranged so that its knife edge presses the screen against the surface of the workpiece along a line of contact therewith. The squeegee is carried by a frame 109 that is, in turn, supported by guide rods 109A extending through openings in the housing 102. A resilient force is provided by a spring 79 in the same arrangement of parts as described above in regard to FIG. 3. Thus, it can be seen that when printing on the cylindrical surface of a workpiece, a direct drive connection is established with the screen by the rack 104 and pinion gear 101. The pinion gear is mounted in a fixed manner concentric with the rotational axis of the squeegee and the rack is mounted to roll the screen surface about the surface of the workpiece.

Figure 11:
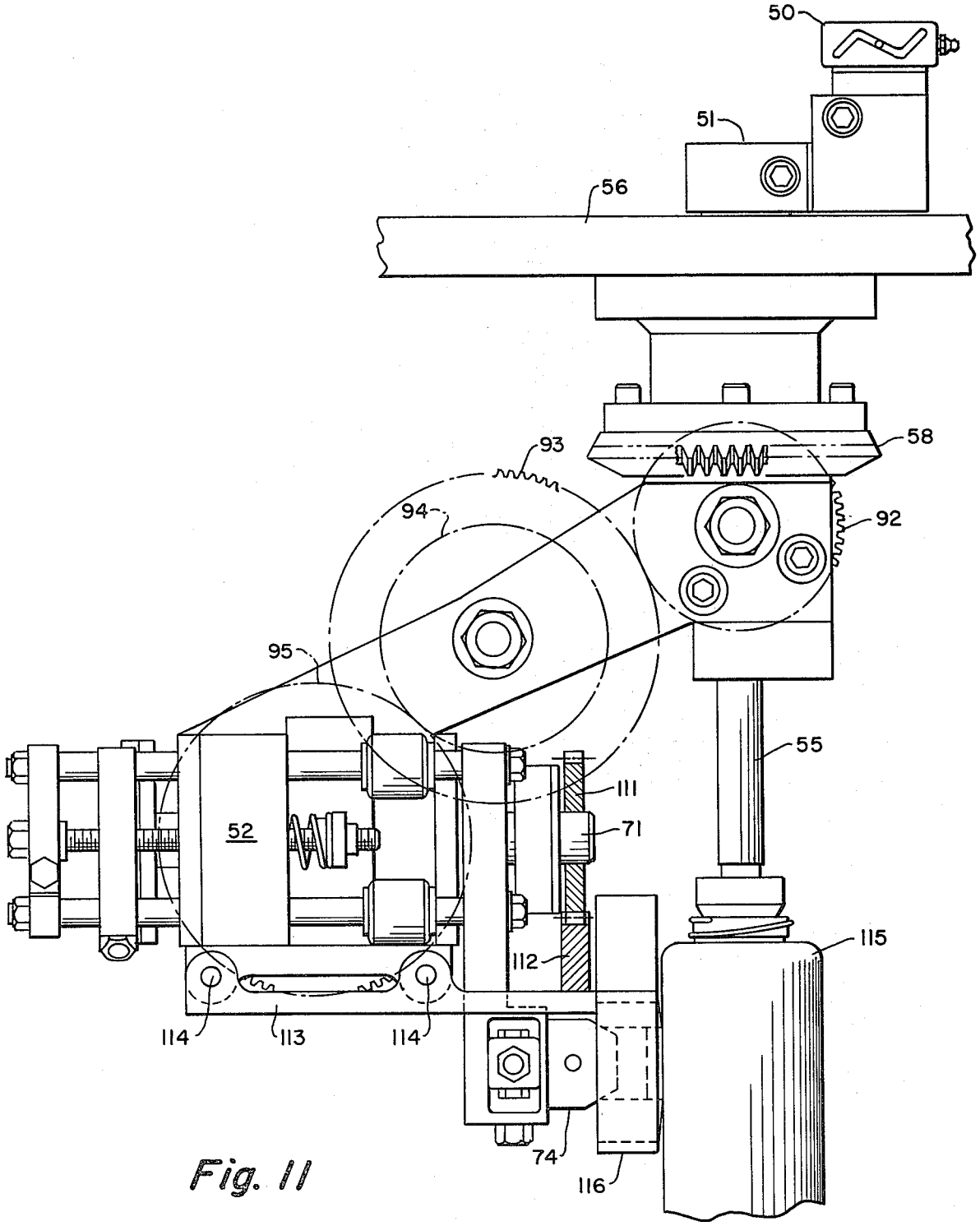
FIG. 11 is a view similar to FIG. 9 to illustrate a further embodiment of the present invention as shown schematically in FIG. 8.

In view of the foregoing, it will be understood by those skilled in the art that as a right-angle relationship is approached between the support axis of the workpiece and the axis about which the face surface of the silk screen is rotated, the radius of a conical surface becomes constant. For practical purposes, it is desirable to establish a maximum radius limit beyond which a conical surface should be treated as a cylindrical surface. At this transition limit, it is necessary to include in the drive train the addition of a gear to drive a rack. Such a gear can take the form of pinion gear 101 or, alternatively, as shown in a further embodiment by FIG. 11, a pinion gear 111 is driven by shaft 71 of housing 52 (FIGS. 3, 5 and 6) rather than by the drive train shown in FIGS. 9 and 10. Gear 111 meshes with rack 112 that carries a frame 113 supported by slide rods 114 on the housing 52 for reciprocating travel as it rolls about the cylindrical surface of a workpiece 115. A silk-screen assembly 116 is attached to the rack 112 or, if desired, to the frame 113. As described previously, the squeegee 74 is urged under a spring-biasing force against the silk-screen assembly 116 to establish line contact between the screen and the cylindrical surface of the workpiece. In the embodiment of FIG. 11, the housing 52 is rotated about support axis 55 of the workpiece and the train of gears 58 and 92-95 delivers torque to shaft 71.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a method of decorating a surface of a workpiece, the steps comprising:

supporting the workpiece against rotation about a support axis spaced from said surface, moving a frame in an orbital path about said surface, positioning a squeegee at one side of a decorating screen to establish line contact between the opposite side of the screen and said surface, swinging the decorating screen from said frame while moving in said orbital path about a pivot axis forming substantially a right angle with said line of contact to roll the decorating screen along said surface, and concurrently therewith, forcing a printing medium through the screen onto said surface at said line of contact by supporting the squeegee from said frame to move along the orbital path thereof about said surface.

2. The method according to claim 1 wherein said tangential path is normally spaced from said surface, said method including the further step of forcing the screen into line contact with said surface by moving the squeegee in a direction toward the surface.

3. The method according to claim 1 wherein said pivot axis forms an acute angle with said support axis.

4. The method according to claim 1 wherein said pivot axis forms a right angle with said support axis.

5. The method according to claim 1 including the further step of moving said workpiece along a path of travel while supporting the workpiece against rotation.

6. Apparatus to decorate a surface of a workpiece, said apparatus including the combination of:

means for supporting a workpiece against rotation about a support axis spaced from a surface of the workpiece for printing thereon, a decorating screen having openings defining a desired pattern for printing on the surface of the workpiece, squeegee means for forcing a printing medium through openings in said screen forming said desired pattern, screen drive means for rolling said decorating screen along a tangential path about the surface of the workpiece, squeegee drive means for moving said squeegee means in an orbital path about said support axis to force a printing medium through openings in said screen while in line contact with said surface of the workpiece, and housing means movable about said axis for carrying said screen and squeegee drive means, said squeegee drive means including a first bevel gear supported about an axis generally coaxial with said support axis, a second bevel gear on said housing means for rotating the housing means about said support axis, drive means for rotating said housing about said surface of the workpiece, and a carrier extending from said housing means for supporting said squeegee means.

7. The apparatus according to claim 6 further including means to advance said workpiece along a path of travel while engaged with said means for supporting.

8. The apparatus according to claim 6 wherein said means for supporting a workpiece includes spaced-apart chuck members at least one of which is movable toward and away from the other for releasably engaging a workpiece.

9. The apparatus according to claim 6 wherein said carrier includes a slide bar coupled at one end to said squeegee means, and resilient means to advance said slide bar and squeegee means toward the surface of said workpiece.

10. The apparatus according to claim 6 wherein said screen drive means includes a pivot shaft carried by said housing means for supporting said decorating screen, a pinion gear coupled to said pivot shaft, a drive gear driven by said second bevel gear, and a gear train meshing in driving relation with said pinion gear and said drive gear for rotating said pivot shaft.

11. The apparatus according to claim 10 wherein said drive gear is supported by said housing means to rotate about an axis perpendicular to said support axis, and wherein said pinion gear is supported by said housing means to rotate about an axis intersecting said support axis.

12. The apparatus according to claim 10 wherein said pinion gear is supported by said housing means to rotate about an axis intersecting and perpendicular to said support axis.

13. The apparatus according to claim 10 wherein said pinion gear is supported by said housing means to rotate about an axis which intersects and forms an acute angle with said support axis.

14. The apparatus according to claim 6 wherein said screen drive means includes a pivot shaft carried by said housing means for supporting said decorating screen, a pinion gear coupled to said pivot shaft, a drive gear supported on said housing means for synchronous rotation with the housing means about said support axis, and a gear meshing in a driving relation with said pinion gear and said drive gear.

15. The apparatus according to claim 6 wherein said screen drive means includes rack and pinion gears.

16. Apparatus to decorate a surface of a workpiece, said apparatus including the combination of:

means for supporting a workpiece against rotation about a support axis spaced from a surface of the workpiece for printing thereon, a decorating screen having openings defining a desired pattern for printing on the surface of the workpiece, squeegee means for forcing a printing medium through openings in said screen forming said desired pattern, screen drive means for rolling said decorating screen along a tangential path about the surface of the workpiece, squeegee drive means for moving said squeegee means in an orbital path about said support axis to force a printing medium through openings in said screen while in line contact with said surface of the workpiece, and housing means movable about said axis for carrying said screen and squeegee drive means, said screen drive means including a pivot shaft carried by said housing means for supporting said decorating screen, a pinion gear coupled to said pivot shaft, a drive gear supported on said housing means for synchronous rotation with the housing means about said support axis, and a gear meshing in a driving relation with said pinion gear and said drive gear.

17. The apparatus according to claim 16 wherein said drive gear is supported by said housing means to rotate about an axis perpendiclar to said support axis, and wherein said pinion gear is supported by said housing means to rotate about an axis intersecting said support axis.

18. The apparatus according to claim 16 wherein said pinion gear is supported by said housing means to rotate about an axis intersecting and perpendicular to said support axis.

19. The apparatus according to claim 16 wherein said pinion gear is supported by said housing means to rotate about an axis which intersects and forms an acute angle with said support axis.

20. The apparatus according to claim 16 wherein said screen drive means includes rack and pinion gears.

21. Apparatus to decorate a surface of a workpiece, said apparatus including the combination of:

means for supporting a workpiece against rotation about a support axis spaced from a surface of the workpiece for printing thereon, a decorating screen having openings defining a desired pattern for printing on the surface of the workpiece, squeegee means at one side of said decorating screen to establish line contact between the opposite side of the screen and said surface for forcing a printing medium through openings in said screen forming said desired pattern, a drive housing for supporting said squeegee means, drive means for rotating said squeegeed means in an orbital path with said drive housing about the said surface of the workpiece, and screen drive means supported by said drive housing for rolling said decorating screen about an axis substantially at a right angle to said line of contact.

22. Apparatus to decorate a surface of a workpiece, said apparatus including the combination of:

means for supporting a workpiece against rotation about a support axis spaced from a surface of the workpiece for printing thereon, a decorating screen having openings defining a desired pattern for printing on the surface of the workpiece, squeegee means at one side of said decorating screen to establish line contact between the opposite side of the screen and said surface for forcing a printing medium through openings in said screen forming said desired pattern, a drive housing for supporting said squeegee means, drive means concentric with said means for supporting for rotating said squeegee means in an orbital path with said drive housing about the said surface of the workpiece, and a screen support carried by said drive housing for rolling said decorating screen about said support axis, said screen drive means including a gear concentric and stationary with respect to said support axis, a rack meshing with said gear for reciprocating said screen support on said drive housing.

* * * * *